US009716944B2

(12) United States Patent
Yliaho et al.

(10) Patent No.: US 9,716,944 B2
(45) Date of Patent: Jul. 25, 2017

(54) ADJUSTABLE AUDIO BEAMFORMING

(71) Applicant: MICROSOFT TECHNOLOGY LICENSING, LLC, Redmond, WA (US)

(72) Inventors: Marko Yliaho, Tampere (FI); Ari Koski, Lempäälä (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 14/673,197

(22) Filed: Mar. 30, 2015

(65) Prior Publication Data

US 2016/0295323 A1 Oct. 6, 2016

(51) Int. Cl.

| | |
|---|---|
| ***H04R 1/02*** | (2006.01) |
| ***H04R 3/00*** | (2006.01) |
| ***H04R 29/00*** | (2006.01) |
| ***H04R 1/40*** | (2006.01) |

(52) U.S. Cl.

CPC ..... *H04R 3/005* (2013.01); *H04R 1/406* (2013.01); *H04R 29/005* (2013.01); *H04R 2201/025* (2013.01); *H04R 2430/23* (2013.01); *H04R 2499/11* (2013.01)

(58) Field of Classification Search

CPC ..... H04R 3/005; G10L 2021/02166; G10L 25/51

USPC ..... 381/92, 91; 455/575.3, 575.4

See application file for complete search history.

(56) References Cited

U.S. PATENT DOCUMENTS

| | | | | |
|---|---|---|---|---|
| 7,415,117 | B2 | 8/2008 | Tashev et al. | |
| 7,667,728 | B2 | 2/2010 | Kenoyer et al. | |
| 7,986,794 | B2 | 7/2011 | Zhang | |
| 8,525,868 | B2 | 9/2013 | Forutanpour et al. | |
| 8,675,890 | B2 | 3/2014 | Schmidt et al. | |
| 8,755,536 | B2 | 6/2014 | Chen et al. | |
| 2006/0271370 | A1 | 11/2006 | Li | |
| 2009/0054111 | A1 | 2/2009 | Takizawa et al. | |
| 2009/0227298 | A1 * | 9/2009 | Fukunaga | H04M 1/0258 455/569.1 |
| 2009/0312075 | A1 * | 12/2009 | Kimbrell | H04M 1/0245 455/575.3 |
| 2010/0131269 | A1 * | 5/2010 | Park | G10K 11/178 704/233 |
| 2010/0208907 | A1 | 8/2010 | Ukai et al. | |

(Continued)

FOREIGN PATENT DOCUMENTS

| | | | | |
|---|---|---|---|---|
| CA | 2499249 | A1 * | 9/2005 | H04M 1/6033 |
| JP | 2010025802 | A | 2/2010 | |

(Continued)

OTHER PUBLICATIONS

"International Search Report and Written Opinion Issued in PCT Application No. PCT/US2016/020314", Mailed Date: May 9, 2016, 11 Pages.

(Continued)

*Primary Examiner* — Alexander Jamal

(57) ABSTRACT

Adjustable audio beamforming of a device having a plurality of microphones is disclosed. A method for forming an audio beam of a device having a plurality of microphones, wherein the device is a deformable device, comprises: recognizing a deforming state of the device; and forming the audio beam according to the recognized deforming state of the device.

20 Claims, 3 Drawing Sheets

(56) References Cited

U.S. PATENT DOCUMENTS

| | | | | |
|---|---|---|---|---|
| 2012/0065973 | A1 | 3/2012 | Cho et al. | |
| 2012/0128160 | A1 | 5/2012 | Kim et al. | |
| 2012/0275621 | A1 | 11/2012 | Elko | |
| 2013/0010982 | A1 | 1/2013 | Elko et al. | |
| 2013/0083944 | A1 | 4/2013 | Kvist et al. | |
| 2013/0101136 | A1 | 4/2013 | McElveen | |
| 2013/0121505 | A1* | 5/2013 | Duraiswami | H04R 3/005 381/92 |
| 2013/0190041 | A1* | 7/2013 | Andrews | H04R 3/005 455/556.1 |
| 2013/0343549 | A1 | 12/2013 | Vemireddy et al. | |

FOREIGN PATENT DOCUMENTS

| | | | |
|---|---|---|---|
| JP | 2010278918 | A | 12/2010 |
| WO | 2014087195 | A1 | 6/2014 |

OTHER PUBLICATIONS

Iain McCowan, "A Microphone Array Tutorial" Aug. 20, 2004—http://www.idiap.ch/~mccowan/publications/mccowan-tutorial-pres.pdf.

Barry Van Veen and Kevin M. Buckley, "Beamforming: a versatile approach to spatial filtering", IEEE Signal Processing Magazine, vol. 5, pp. 4-24, 1988.

Wolfgang Herbordt and Walter Kellermann—"Adaptive Beamforming for Audio Signal Acquisition" available at http://wolfgangherbordt.de/resources/Herbordt-springer03-Adaptive_beamforming_for_audio_signal_acquisition.pdf, 2003.

"International Preliminary Report on Patentability Issued in PCT Application No. PCT/US2016/020314", Mailed Date: Apr. 19, 2017, 9 Pages.

* cited by examiner

ADJUSTABLE AUDIO BEAMFORMING

BACKGROUND

Various devices such as portable and mobile devices may incorporate microphones by which audio capture can be carried out. The audio signals may be used for different purposes such as, for example, a voice call, a video call, speech recognition, or video recording.

A plurality of microphones can capture audio signals at varying signal strength depending on the location of the microphones with respect to the audio source.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Adjustable audio beamforming for a device having a plurality of microphones is described. A method for forming an audio beam of a device having a plurality of microphones may be carried out, for example, by processing output signals of microphones of the plurality of microphones to form a combined output signal corresponding to the audio beam. The device may be a deformable device, wherein the method may comprise recognizing a deforming state of the device, and forming the audio beam according to the recognized deforming state of the device.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

The drawings are not in scale.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

Although some of the present examples may be described and illustrated herein as being implemented in a smartphone, a mobile phone, or a tablet computer, these are only examples of a device and not a limitation. As those skilled in the art will appreciate, the present examples are suitable for application in a variety of different types of devices, such as portable and mobile devices, for example, in lap top computers, tablet computers, game consoles or game controllers, various wearable devices, such as a smart clothing device, etc.

When the device incorporates a plurality of microphones, it is possible to enhance the directional selectivity of the audio capture by means of audio beamforming, i.e. formation of one or more specific audio beams, to selectively strengthen the audio signals originating from the directions according to the audio beams, whereas suppressing the audio signals originating from the other directions.

The audio beam formation is affected by the positioning of the microphones, in particular the positioning of the microphones relative to each other.

Figure 1:
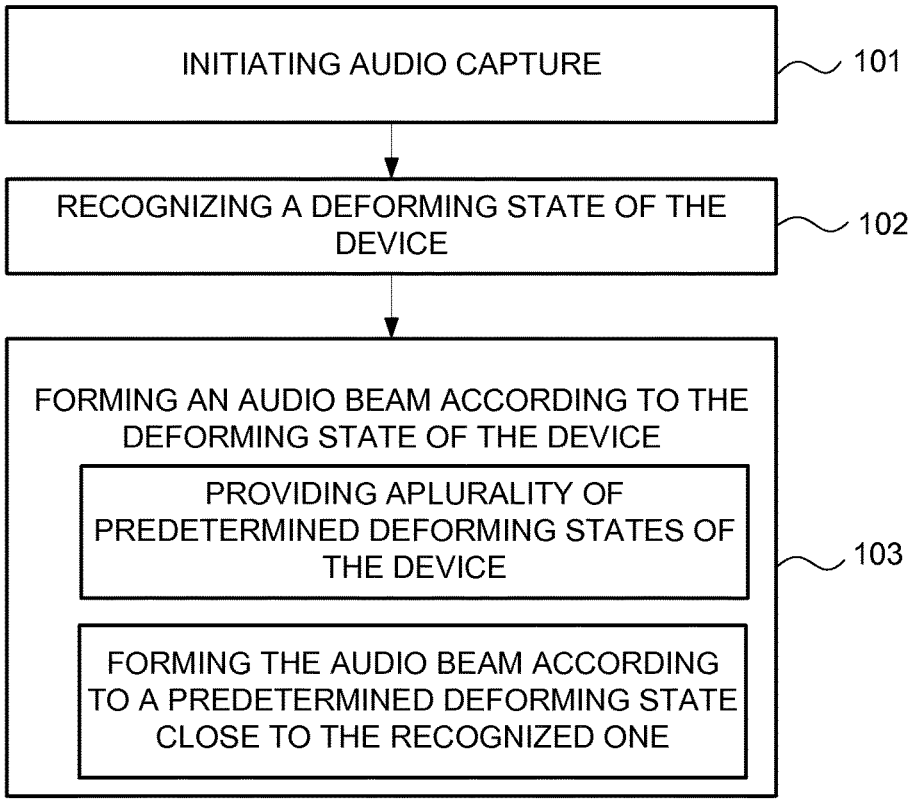
FIG. 1 illustrates a beamforming method.

FIG. 1 shows, as a schematic flow chart, a method for forming an audio beam of a deformable device having a plurality of microphones. The audio beam formation may be carried out generally by processing output signals of microphones of the plurality of microphones to form a combined output signal corresponding to the audio beam. Such method for forming an audio beam may also be called a "beamforming" method. In the example of FIG. 1, just one audio beam is formed. In another example, two or more audio beams may be formed simultaneously. In general, "forming an audio beam" refers to "forming at least one audio beam".

When a microphone receives an acoustic signal, i.e. sound, the microphone may convert the received signal into an electrical output signal, generally called an "output signal". The output signal can be then processed and combined with corresponding processed output signals from other microphones of the plurality of microphones. Thereby, a common output signal may be generated. The common output signal may represent the actual captured audio signal. Thus, "acoustic signal" refers to the actual sound, whereas "audio signal" refers to a captured, typically electric signal representing the original acoustic signal.

An "audio beam" means here a three-dimensional zone or region in the three-directional ambient, i.e. the surroundings, of the plurality of microphones, corresponding to the effective directivity pattern of the audio capture. Such "audio beam" thus refers to directional, i.e. non-isotropic, sensitivity of the audio capture carried out by the microphone array.

Forming an audio beam generally refers to a procedure for generating one or more receiving audio beams by a plurality of microphones distributed in different locations in the device, for example, as one or more microphone arrays.

In general, forming an audio beam comprises processing microphone output signals from at least two microphones by filtering and summing them in such a way that after the processing, the audio signals originating from acoustic signals received from directions within the audio beam(s) are strengthened, whereas the audio signals originating from acoustic signals received from the other directions are suppressed in the resulting common output signal. The filtering may comprise controlling the relative phases and amplitudes of the output signals from different microphones. Thus, in the strengthening and suppressing the different signals, constructive and destructive interference of the signals may be utilized in addition to simple weighing, i.e. amplifying or attenuation of the signal amplitudes. The filtering and summing determines the audio beam, i.e. the effective directional sensitivity pattern of the group of microphones used in the beamforming, where "effective" refers to the directional sensitivity pattern of the group of microphones after the signal processing, which may differ from the initial directivity pattern of the plurality of microphones.

The details of the filtering and summing procedure as a whole may be called the "parameters" of the beamforming, or simply "beamforming parameters".

The algorithm or procedure by which the beamforming is carried out may be called a beamformer. In general, in its simplest form, beamforming can be carried out by a delay-and-add beamformer which delays (by adding a positive or negative delay) and weights each microphone output signal in a controlled manner and sums the thereby processed individual output signals together, whereby in the summed output signal, the audio signals corresponding to the acoustic signals from the directions of the desired audio beam(s) are reinforced. The delay-and-add beamformer illustrates one example of the principle of beamforming. In another example, some other, possibly more complex beamformer may be used, such as, for example, Linearly Constrained Minimum Variance LCMV beamformer, Generalized Sidelobe Canceller GSC, Frost Adaptive beamformer, Griffiths-Jim adaptive beamformer, and Minimum Variance Distortionless Response MVDR beamformer. A sophisticated beamformer may be based on, for example, a multi-stage approach where possibly several levels of virtual microphones are formed from the individual output signals.

To enable beamforming, the minimum number of microphones of the plurality of microphones is two. On the other hand, there is generally no upper limit for the number of microphones.

The device in which the microphones are incorporated may be, for example, a portable or mobile device, such as a laptop computer, a mobile or smart phone, a tablet computer, a game console or game controller, a wearable device, such as a smart cloth, or a general-purpose audio capture device.

The deformability of the "deformable" device refers to the overall shape and/or dimensions of the device being changeable. This may be enabled, for example, by a flexible nature of at least part of the device allowing bending, folding, or rolling of the device. For example, the device may have two or more device portions foldably connected to each other, whereby the device may be reversibly foldable between a plurality of folding states. Then, the deforming state of the device may thus be the folding state thereof. In another example, the device may have substantially rigid device portions hingedly connected to each other to allow turning the device portions relative to each other about a hinge. Alternatively, the device may incorporate, for example, different device portions slidably connected to each other to allow sliding of the device portions relative to each other.

The method of FIG. 1 comprises initiating, in step 101, audio signal capture by the plurality of microphones. Here the plurality of microphones may refer to all microphones incorporated in the device. On the other hand, it may also refer to some specific group of those microphones.

In step 102, the method comprises recognizing a deforming state of the device. This may comprise recognizing a relative microphone positioning of the plurality of microphones. Microphone positioning refers to both the location of a microphone in the device, and the directional position thereof relative to the device or a specific reference portion thereof. Relative microphone positioning of the plurality of microphones, in turn, refers to the locations and positions of the microphones relative to each other. The relative microphone positioning affects the phase differences in the output audio signals captured by different microphones.

From the relative microphone positioning point of view, the deformability of the device, when the plurality of microphones is distributed in various locations in the device, may allow the relative microphone positioning to change when the device is being deformed, i.e. when the overall device shape and/or dimensions change. For example, in the above example of a foldable device with at least two device portions foldably connected to each other, the microphones may be distributed so that each device portion has at least one microphone. Then, when the folding state of the device is changed, the relative microphone positioning changes. The prevailing relative positioning of the plurality of microphones is known for proper beamforming. In another example, the microphones may be so located that at least some deformation of the device may take place without changes in the relative microphone positioning. For example, this may be the case in a device with two substantially rigid device portions movably connected to each other, all the microphones of the plurality of microphones being located in one of those device portions.

When the deforming state of the device is known, the audio beam is formed, in step 103, according to the recognized deforming state of the device. In other words, the deforming state of the device is taken into account in the actual beamforming. The audio beam to be formed by the beamforming procedure is thus determined on the basis of the deforming state of the device. This allows adaptation of the audio beam formation according to the prevailing deforming state of the device.

In the above example where recognizing the deforming state of the device comprises recognizing a relative microphone positioning of the plurality of microphones, the audio beam may be formed according to the recognized relative microphone positioning. Thus, the audio beam formation may be adjusted according to the prevailing relative microphone positioning of the plurality of microphones.

In addition to, or instead of, the relative microphone positioning, the audio beam may be also formed according to other factors related to the deforming state of the device. For example, if the device comprises a loudspeaker, the audio beam(s) may be formed to be directed away from the loudspeaker. Thus, in this example, the beamforming may be adjusted according to the relative positioning of the loudspeaker and the microphones. In another example, if the deforming state of the device is such that a part of the device, e.g. a particular device portion thereof, lies in the direction of an audio beam otherwise possible for the associated relative microphone positioning, another audio beam may be formed. Thus, in this example, the audio beam may be formed according to the overall device shape and dimensions. Such portion of a device possibly "blocking" the audio beam in some specific deforming state(s) of the device may be present in any type of deformable device.

Selecting the appropriate beamforming parameters to form the audio beam may comprise selecting the microphones, the output signals of which are used in forming the common output signal corresponding the audio beam. In other words, some audio beams may be formed using one specific group of microphones, whereas some other audio beam may be formed using some other group of microphones.

As illustrated in FIG. 1, with regard to carrying out the beamforming "according to the recognized deforming state of the device", in step 103, the method may comprise providing a plurality of predetermined deforming states of the device, and a predetermined audio beam for each such deforming state of the device. Then, the audio beam may be formed, i.e. the beamforming parameters may be selected, according to a predetermined audio beam related to a predetermined deforming state of the device corresponding to the recognized deforming state of the device. In other words, the recognized deforming state of the device may be compared with the predetermined ones, and a predetermined deforming state of the device which is closest to, or otherwise "corresponds to", the recognized one, may be selected to represent the prevailing deforming state of the device. Then, the predetermined audio beam associated to that particular predetermined device deforming state may be selected as the audio beam to be formed in the method.

The predetermined audio beams associated with the predetermined deforming states of the device may be determined so that a specific intended audio beam configuration, i.e. the audio beam(s) directivity pattern relative to the device or a reference portion thereof, can be achieved in different deforming situations of the device, i.e. irrespective of the prevailing overall shape and/or dimensions of the device. In other words, the predetermined deforming states of the device and the associated predetermined audio beams may be selected so that the audio beam(s) to be formed relative to the device or a reference portion thereof is the same irrespective of the prevailing overall shape of deformable device.

As another alternative, the predetermined deforming states of the device may be associated with predetermined assumed use cases of the device, i.e. assumed ways of use thereof. For example, in the case of a foldable device having an open and a closed position with different relative microphone positionings, the recognized deforming state, i.e. folding state, of the device can be used as an indication of the way the device is being used. The predetermined audio beams may be selected differently for different assumed use cases. For example, one particular deforming state of the device may be used as an indication of the device being used for a voice call, whereas some other deforming state of the device may be considered indicating use of the device for video recording, for example. Naturally these are merely illustrative and simplified examples of various use cases and the determination thereof. Moreover, conclusions on the assumed way of use of the device may be made also on the basis of other information than the deforming state of the device, the relative positioning of the device portions, or the relative microphone positioning associated with the prevailing deforming state of the device. Such other information may be, for example, information about the applications being used in the device. Another example is the orientation of the device.

In the example of FIG. 1, just one step of recognizing the prevailing deforming state of the device is illustrated, followed by once forming the audio beam(s) according to the thereby recognized deforming state of the device. This approach may be used in situations where the device is not assumed to be deformed during the audio capture event. Naturally, the steps of FIG. 1 may also be considered as single steps of a continuous process where both the recognition of the deforming state of the device, possibly comprising recognition of the relative microphone positioning, and the formation of the audio beam are carried out repeatedly. In other words, the method may also comprise continuously monitoring the deforming state of the device, possibly comprising continuously monitoring the relative microphone positioning, and changing the beamforming parameters when a change of the deforming state of the device and/or the relative microphone positioning is detected. For example, in the case of a foldable or bendable device, the deforming state to be monitored may be the folding or bending state of the device, respectively. In the case of forming several simultaneously used audio beams, a first group of audio beams may be formed for a first deforming state of the device, and a second group of audio beams may be formed for a second deforming state of the device. The first and the second audio beam groups may differ from each other in the number of audio beams and/or in the directions of the individual audio beams thereof.

Figure 2:
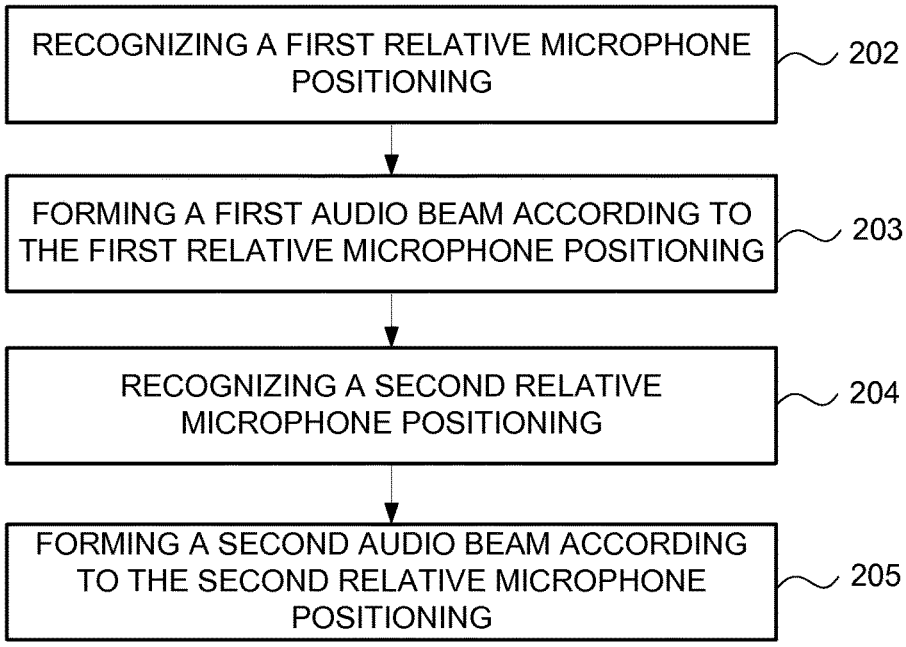
FIG. 2 illustrates a beamforming method.

FIG. 2 illustrates, as a schematic flow chart, an example of a situation where the audio beam to be formed may be changed during one single audio capture event. The details and ways of implementation of the method with regard to the recognition of the relative microphone positioning as well as the formation of the audio beam may be carried out as explained above in the context of the example of FIG. 1. In the example of FIG. 2, recognizing a first and a second relative microphone positioning, and forming a first and a second audio beam accordingly, is an example of more generally recognizing a first and a second deforming state of the device, and forming a first and a second audio beam accordingly.

In the method of FIG. 2, a first relative microphone positioning of the plurality of microphones is first recognized in step 202. Although initiation of the audio signal capture is not illustrated in the flow chart of FIG. 2, it may be comprised in the method of FIG. 2 also. A first audio beam according to the first relative microphone positioning is formed in step 203. A second relative microphone positioning of the plurality of microphones is thereafter recognized in step 204; followed by forming a second audio beam according to the second relative microphone positioning in step 205.

As explained above, the device may have a reference portion relative to which the audio beam is determined. In one approach, the first and the second audio beams may be directed substantially to the same direction relative to such reference portion. In another approach, the first audio beam may be directed to a first direction relative to the reference portion, and the second audio beam may be directed to a second direction relative to the reference portion, which is different from the first direction. The latter approach may be used, for example, when a change in the relative microphone positioning is considered as an indication of a change in the way of use of the device.

Instead of utilizing a plurality of predetermined relative microphone positionings and associated predetermined audio beams, it may be possible to optimize the audio beam from scratch for each recognized relative microphone positioning, possibly taking also into account an assumed use case of the device.

In the above examples, recognizing the relative microphone positioning may be based on knowledge of the microphone locations and positions in the device, together with knowledge of the device deforming state, i.e. the overall shape and dimensions of the device. For example, the device may have a plurality of device portions, whereby the device may be deformable by changing the relative positioning of those device portions. When the plurality of microphones is distributed to known microphone sites located in the different device portions, the relative microphone positioning may be recognized by actually recognizing the relative positioning of the device portions, and by determining the relative microphone positioning of the plurality of microphones on the basis of the relative positioning of the device portions and the locations of the microphone sites in the device portions. Vice versa, the deforming state of the device may be recognized by actually recognizing the relative microphone positioning of the plurality of microphones, and by determining the deforming state of the device on the basis of the recognized relative microphone positioning of the plurality of microphones and the locations of the microphone sites in the device portions.

For recognizing the relative device portion positioning, various approaches may be used. For example, in the case of a hinged device configuration, the rotational position of the hinged device portions relative to each other may be determined by a device deforming sensor detecting the opening angle of the hinge. Also in the case of a generally bendable or foldable device configuration, properly located sensors, such as piezoelectric sensors, hall sensors, or strain gauges, may be used to detect the deforming state of the device.

As an alternative to the approach based on known locations and positions of the microphones and recognition of the relative positioning of the device portions, the relative microphone positioning may also be based on an acoustic test signal. For example, when the device comprises a loudspeaker, the loudspeaker may be used to transmit a test acoustic signal which may then be received by microphones of the plurality of microphones. There is a specific loudspeaker-to-microphone acoustic path for the acoustic test signal for each microphone. The length of such path affects the amplitude and phase of the received signal. Due to the differences of the paths of different microphones, the output signals of the microphones in response to the test audio signal transmission vary. Therefore, the relative microphone positioning may be determined on the basis of differences in the test output signals.

In the above, examples has been discussed mainly focusing on a method aspect. In the following, more emphasis is put on issues related to device configurations by which the above examples of the method aspect may be implemented. On the other hand, the above explanation may be considered discussing possible ways of operation of the device examples discussed below. What is stated above, in the context of the method aspect, about definitions, details, way of implementation, and possible advantages apply, whenever appropriate, to the device aspects below. The same applies vice versa.

Figure 3:
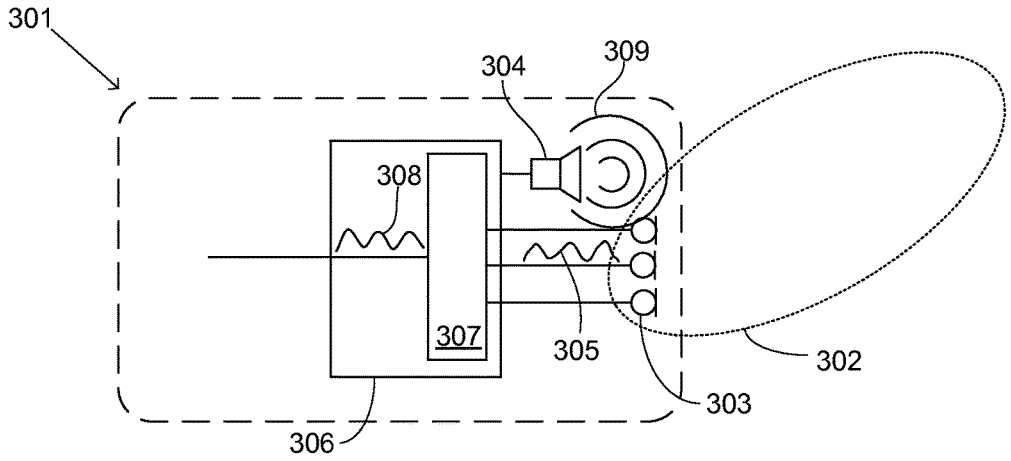
FIG. 3 illustrates a deformable device.

FIG. 3 illustrates a schematic block diagram of a deformable device 301 capable of carrying out audio capture, using an adjustable audio beam 302. The device may be, for example, a portable or mobile electronic device, such as a laptop computer, a mobile phone, a smart phone, just to mention a few examples.

The device 301 has a plurality of microphones 303 which may be distributed in the deformable device so that the relative positioning of the microphones may change when the device is being deformed, i.e. when the deforming state of the device is being changed. For example, the device may be a bendable device, whereby the relative microphone positioning changes when device is being bent, i.e. when the deforming state of the device is being changed. In another example, the microphones may be located in the device such that no relative microphone positioning change occurs when the device is being deformed. In FIG. 3, the deformability and the corresponding changeability of the deforming state of the device is illustrated by the curved outline of the device, drawn by a dashed line.

The microphones 303 of the example of FIG. 3 may be analog or digital microphones. During audio capture, each microphone 303 produces an output audio signal 305, i.e. an electric signal representing the acoustic signal received by that particular microphone.

In FIG. 3, there are three microphones 303 illustrated. However, it is important to note that this is one example only. In practice, a deformable device for audio capture with an adjustable audio beam may have any number of microphones exceeding or equal to two.

The device 301 also comprises a processing system 306 configured to control the operations of the device. The processing system 306 may comprise e.g. a general purpose processor (GPP) and one or more digital signal processors (DSP) and/or one or more additional or auxiliary general purpose processors for performing various tasks related to the device operations. In the case of analog microphones, the processing system may also comprise an analog to digital converter (ADC).

The processing system 306 is configured to recognize a deforming state of the device, which may comprise recognizing a relative microphone definition of the plurality of microphones. This may be carried out by the general purpose processor or in a digital signal processors or an additional or auxiliary general purpose processor. In recognition of the deforming state of the device or the relative microphone positioning, for example, procedures as described above in the context of the method aspects may be used.

The microphones 303 are connected to the processing system 306 so that the output signals 305 thereof may be transmitted to the processing system. The processing system 306 comprises a circuitry 307 which is configured to process the output signals 305 of the microphones 303 so as to form a common output signal 308 corresponding to the desired audio beam 302. In other words, the common output signal, which may be in electrical form, represents acoustics signals collected from the region of the audio beam. The audio beam formation may be carried out, for example, as explained above in the method. It may comprise filtering and summing the individual output signals, thereby forming a common output signal 308 in which the acoustic signals from the region of the audio beam are strengthened relative to acoustic signals from other directions.

The circuitry 307 is also configured to receive a deforming state of the device, which may comprise receiving a relative microphone positioning of the plurality of microphones 303. Further, being configured to process the output signals 305 of the microphones 303 is arranged so that the circuitry 307 is configured to form the audio beam 302 according to the relative positioning of the microphones.

"Receiving" the deforming state of the device or the relative microphone positioning refers to the circuitry 307 possibly itself recognizing the deforming state of the device or the relative microphone positioning. For example, the relative microphone positioning can be determined on the basis of known microphone positions in the device and the prevailing deforming state of the device or on the basis of differences in output signals of the microphones in response to a test audio signal. The other way round, the deforming state of the device can be determined on the basis of known microphone positions in the device and the relative microphone positioning determined on the basis of differences in output signals of the microphones in response to a test audio signal. On the other hand, predetermined deforming state of the device or relative microphone positioning may be received by the circuitry. In the latter case, the actual recognition of the prevailing deforming state of the device or the relative microphone positioning may be carried out by some other circuitry or unit of the processing system 306. In both cases, the audio beam formation is carried out on the basis of the recognized deforming state of the device, possibly on the basis of the recognized relative microphone positioning.

The audio beam formation may be carried out once for each audio capture event. Alternatively, the circuitry 307 may be configured to receive a first deforming state of the device or a first relative microphone positioning of the plurality of microphones; form a first audio beam according to the first deforming state of the device or the first relative microphone positioning; receive a second deforming state of the device or a second relative microphone positioning of the plurality of microphones; and form a second audio beam according to the second deforming state of the device or the second relative microphone positioning.

The circuitry 307 configured to carry out the actual beamforming may be implemented in various ways. The processing system 306 may comprise e.g. at least one processor and at least one memory coupled to the processor. The memory may store program code instructions which, when run on the processor, cause the processor to perform various audio capture operations, including those of the beamforming discussed above. Alternatively, or in addition, the functionally described features can be performed, at least in part, by one or more hardware logic components. For example, and without limitation, illustrative types of hardware logic components that can be used include Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), etc.

In one example, the processing system 306 may comprise a chipset having a GPP and one or more DSPs, one of the latter serving as the circuitry performing the actual beamforming. The DSP carrying out the beamforming may be, for example, a multimedia DSP possibly configured to carry out also other multimedia-related tasks. As an alternative to a DSP, the beamforming circuitry may also be implemented as an additional or auxiliary GPP included in the chipset.

In another example, wherein the microphones 303 are analog microphones, the processing system 306 comprises an audio codec having a DSP which forms the circuitry configured to receive the relative microphone positioning and forming the audio beam accordingly.

In yet alternative examples, such circuitry may be implemented as a hardware block located, for example, in an audio codec, or as a separate application specific integrated circuit ASIC contained in the processing system.

The device 301 of FIG. 3 also has a loudspeaker 304 by which test acoustic signals 309 as discussed above in the methods, for example, may be transmitted. When the microphones 303 receive a test acoustic signal 309, their output signals 305 serve as test output signals, based on which the deforming state of the device or the associated relative microphone positioning of the plurality of microphones 303 may be determined.

The general configuration, operation, and structure of the deformable device 301 of FIG. 3 may be, for example, in accordance with the examples of FIGS. 4 to 8 discussed below.

Figure 4:
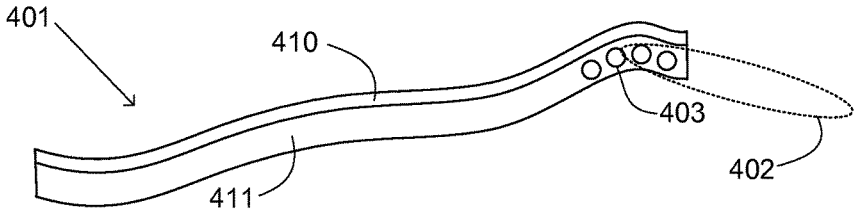
FIG. 4 illustrates a deformable device.

FIG. 4 shows, as a schematic side view drawing, an example of a bendable mobile electronic device 401. A bendable display assembly 410 is integrated into the device to serve as a display thereof. The device body 411, as well as the internal structures thereof with various elements and components (not shown) of the device, are bendable substantially freely in any direction(s).

The bendable device 401 of FIG. 4 has an array of four microphones 403 located on the side of the device. The relative positioning of the microphones 403 vary along the changes of the device bending state, i.e. along the changes of the deforming state of the device. Location of the microphone array on the side of the device is just one example illustration. In another example, microphones may be located, instead of, or in addition to the side microphones 403, on the front or back faces of the device 401. Various audio beams 402 may be formed by the microphones 403 according to the deforming state of the device 401, one of which being illustrated in FIG. 4.

Figure 5A:
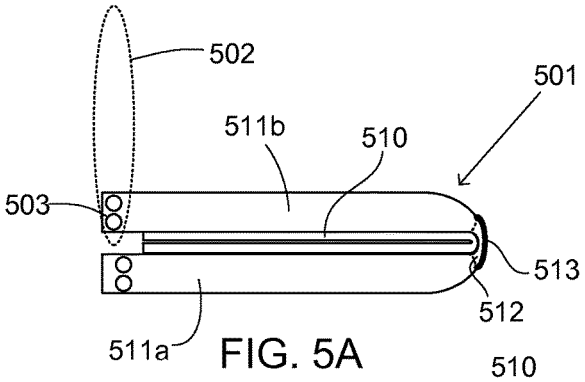
FIGS. 5A and 5B illustrate a deformable device.
Figure 5B:
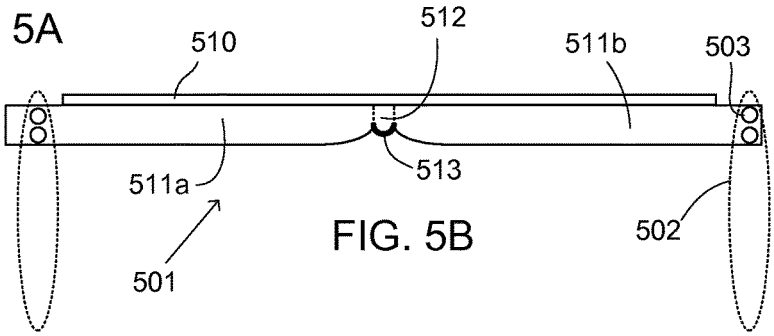

FIGS. 5A and 5B show, as schematic side view drawings, a foldable mobile electronic device 501, which may be, for example, a mobile phone or a smart phone. The foldable device 501 has a body with two device portions 511*a*, 511*b* which are foldably connected to each other via a folding member 512 so that the device portions can be turned relative to each other, thereby changing the relative positioning of those two device portions. The deforming state of the device 501 is thus defined by the relative positioning of the two device portions 511*a*, 511*b*, i.e. by the folding state of the device 501. In an example, the device portions 511*a*, 511*b* are substantially rigid. In another example, the device portions 511*a*, 511*b* are flexible. A flexible display 510 is integrated in the device 501, extending as a single continuous element from one device portion to another 511*a*, 511*b*. The device 501 of FIGS. 5A and 5B comprises two pairs of microphones 503, one pair at each end of the device outside the display 510 area.

In FIG. 5A, the device 501 is in a closed position according to a first folding state of the device, in which position the device portions 511*a*, 511*b* are lying one on the other. FIG. 5B illustrates another, open position, according to another folding state. The device 501 is reversibly foldable in any folding states between and including the two illustrated in FIGS. 5A and 5B.

The two pairs of microphones 503 of the device 501 may be used for beamforming purposes, for example, in the following manner. First, in the open position illustrated in FIG. 5B, each of the two pairs of microphones 503 may be used to form one audio beam 502 facing towards the back side of the device 501, i.e. the side opposite to the display 510 side of the device. Such audio beams 502 may be utilized, for example, in stereo audio recording for video recording, assuming there is a camera (not illustrated in the drawings) facing to the back side of the device. On the other hand, in the closed device position illustrated in FIG. 5A, it may be sufficient to use only one group of the two microphone 503 groups to form a single audio beam 502. Alternatively, all four microphones may be used to form one narrow audio beam.

The device 501 of FIGS. 5A and 5B also has a device deforming sensor 513 integrated in the folding member 512. The device deforming sensor 513 may comprise, for example, a piezoelectric sensor, a hall sensor, or a strain gauge. Using the device deforming sensor 513, the "form", i.e. the deforming/folding state of the device or the relative positioning of the device portions 511*a*, 511*b* may be recognized. This recognized folding state may further be used to recognize the relative microphone positioning by determining the relative microphone positioning on the basis of the detected form of the device 501 and known locations of the microphones 503 in the device portions. The audio beam 502 may then be formed according to beamforming parameters corresponding to the recognized folding state of the device 501.

The location of the device deforming sensor 513 in the folding member is just one example. In other examples, a deforming sensor may be located in any appropriate locations in a deformable device. In the case of a foldable device, for example, a deforming sensor may comprise a proximity sensor located to detect the distance of particular locations of the foldably connected device portions.

The recognition of the folding state of the device 501 may be performed as continuous monitoring, wherein the beamforming parameters may be changed when a change of the folding state is detected. The beamforming parameters may be selected according to an assumed use case of the device 501, which may be determined, for example, on the basis of the recognized folding state of the device.

In FIGS. 5A and 5B, the device 501 has microphones 503 arranged in "vertical" pairs, i.e. superposed in the direction perpendicular to the planes of the device portions 511*a*, 511*b*. This enables, as illustrated, forming audio beams 502 which are directed substantially perpendicularly to those planes. By adding in the device portions 511*a*, 511*b* also microphones placed "laterally", i.e. at locations differing from the other microphones 503 in the direction of the planes of the device portions, more versatile orientation of the audio beams 502 become possible. One simple example of this is illustrated in FIG. 6.

Figure 6:
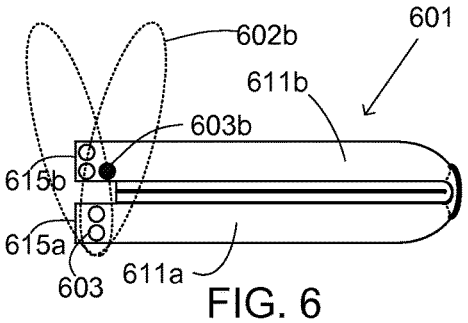
FIG. 6 illustrates a deformable device.

FIG. 6 shows a device 601 differing from that of FIGS. 5A and 5B in that one of the device portions 611*a*, 611*b* has an additional microphone 603*b* outside the pair of microphones 603 of that device portion. In an example, the additional microphone 603*b*, illustrated as a black solid circle in FIG. 6, may be used when the device 601 is in its closed position and inactive, i.e. not in use, when the device is in its open position. In another example, the additional microphone 603*b* can be used when the device 601 is in its open position. Because the two microphone 603 pairs are located at different distances from their corresponding device ends 615*a*, 615*b*, those pairs are offset from each other when the device is in its closed position. This can be utilized in beamforming so that by using the both microphone 603 pairs and the additional microphone 603*b*, two audio beams 602*b* may be formed which are directed differently from each other. Such beams may be formed simultaneously. In another example, one audio beam may be formed and used at a time.

Figure 7:
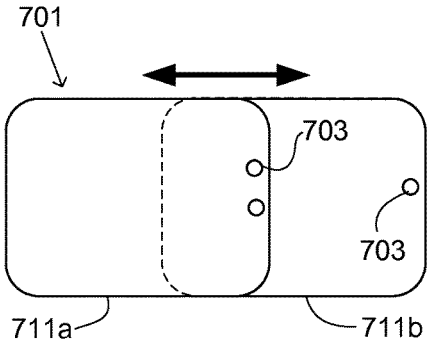
FIG. 7 illustrates a deformable device.

FIG. 7 shows a schematic top view of a mobile device 701 which, similarly to the devices of FIGS. 5A and 5B and FIG. 6, comprises two device portions 711*a*, 711*b* with a changeable relative device portion positioning, i.e. a changeable deforming state of the device 701. The two device portions 711*a*, 711*b* comprise microphones 703. Instead of a foldable connection, the two device portions 711*a*, 711*b* of the device 701 are slidably connected to each other so that they can reversibly slide relative to each other, as illustrated by the arrow marked in FIG. 7. This device 701 is thus deformable by changing the relative positioning of the device portions 711*a*, 711*b* by sliding the device portions relative to each other. The relative microphone positioning changes when the device 701 is being thereby deformed. For different relative positionings of the device portions 711*a*, 711*b*, different microphone groups may be used for beamforming. In another example, all microphones may be located in one device portion so that a change in the deforming state, i.e. in the sliding state, of the device causes no change in the relative microphone positioning.

Figure 8A:
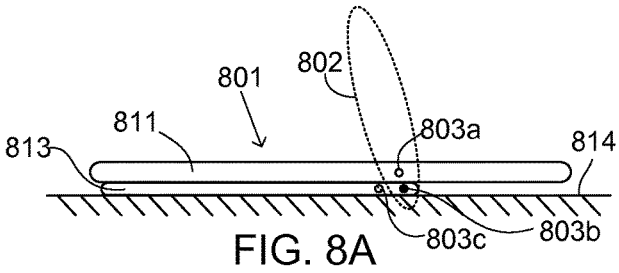
FIGS. 8A to 8C illustrate a deformable device.
Figure 8B:
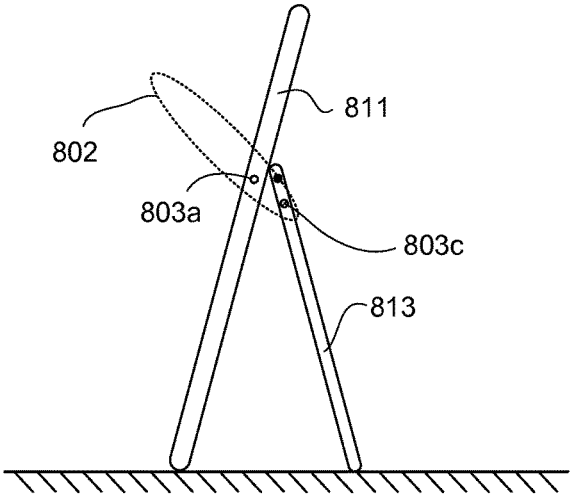
Figure 8C:
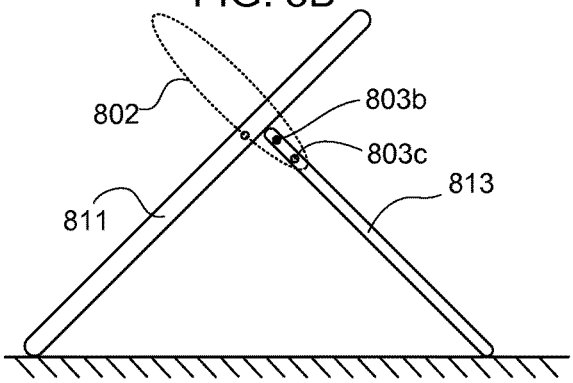

FIGS. 8A to 8C show, as schematic side view drawings, a mobile electronic device 801, which can be, for example, a smartphone or a tablet computer, having a device body 811 and an integrated stand 813 which is turnably connected to the device body. There are three microphones 803*a*, 803*b*, 803*c* in both sides of the device (only other three visible in the drawing), one in the device body 811 and two in the stand 813.

In FIG. 8A, the device 801 is lying on a surface 814 of, for example, a table. The device 801 is illustrated in "flat" overall form with the stand 813 lying against the device body 811. With this deforming state, the microphone 803*a* in the body 811 (illustrated by a white circle in FIGS. 8A to 8C) and one of the microphones 803*b* in the stand 813 (illustrated by a black circle in FIGS. 8A to 8C) may be used for forming an audio beam 802 directed towards an assumed location of the user of the device.

When the device body 811 is standing against the stand 813 to form a small angle, as illustrated in FIG. 8B, the other microphone 803*c* of the stand 813 (illustrated by a grey circle in FIGS. 8A to 8C) may be used together with the microphone 803*a* of the device body 811 to direct the audio beam 802 towards the assumed position of the user with this position of the device.

When the device body 811 is standing against the stand 813 to form a wider angle, as illustrated in FIG. 8C, the two microphones 803*b*, 803*c* of the stand 813 may be used for beamforming.

In the examples of FIGS. 7 and 8, one or more device deforming sensors may be incorporated in the devices, corresponding with the example of FIGS. 5A, 5B, and 6, to serve for recognizing the relative positioning of the device portions. The type and location of such deforming sensor may differ from those of the examples of FIGS. 5A, 5B, and 6.

In the drawings of FIGS. 4 to 8, the microphones are marked simply by general drawing symbols or figures denoting the microphones to denote the locations of the microphones, i.e. microphone "sites" in the devices.

Audio beamforming in devices of FIGS. 4 to 8 may be generally carried out according to any of the examples discussed above in the methods illustrated in FIGS. 1 and 2, for example. For example, a part of a device or a device body may be considered as a reference portion of the device, relative to which the audio beams are directed. A first audio beam may then be formed, directed to a first direction relative to the reference portion, according to a first deforming state of the device or a first relative microphone position recognized. When a second deforming state of the device or a second relative microphone position is recognized, a second audio beam may be formed according to the second deforming state of the device or the second relative microphone positioning. The second audio beam may be directed substantially to the same direction relative to the reference portion as the first audio beam. An example of this is illustrated in FIGS. 8A and 8B where the audio beams 802 in those two situations, which can be considered as a first and a second audio beams formed according to a first and a second relative microphone positioning, respectively, are directed similarly relative to the device body 811 serving as a reference portion of the device. An alternative example is illustrated in FIGS. 8B and 8C where the direction of the audio beam 802 relative to the device body is changed when the opening angle of the stand and thereby also the relative microphone positioning is changed.

The three situations shown in FIGS. 8A to 8C provide also an illustration of another beamforming method example, namely, the change of the microphone group used in forming audio beam. Three different groups of microphone are used in those three different situations.

In the examples of FIGS. 4 to 8, the devices comprise integral bodies, possibly having device portions movably connected to each other. In another example, the deformable device can have multiple detachable components or device portions.

It is important to note that in the above method and device examples, any feature of an example may be combined with the features of any other example, whenever appropriate, although such combination would not be explicitly suggested.

In any of the method and device examples discussed above, at least one of the microphones of the plurality of microphones, possibly all of them, is an omnidirectional microphone, i.e. a microphone without a specific directivity pattern. The microphones may be of any type suitable for use in a deformable device. For example, they may be micro electro mechanical system MEMS microphones or electret condenser microphones ECM.

Some embodiments are further discussed shortly in the following.

According to an aspect, a method for forming an audio beam of a device having a plurality of microphones, for example, by processing output signals of microphones of the plurality of microphones to form a combined output signal corresponding to the audio beam, wherein the device may be a deformable device, comprises: recognizing a deforming state of the device; and forming the audio beam according to the recognized deforming state of the device.

In an embodiment, the method comprises providing a plurality of predetermined deforming state of the device, and a predetermined audio beam for each such deforming state of the device, and wherein the audio beam is formed according to a predetermined audio beam related to a predetermined deforming state of the device corresponding to the recognized deforming state of the device.

In an embodiment, which may be in accordance with the above embodiment relying on predetermined deforming states of the device, the method comprises: recognizing a first deforming state of the device; forming a first audio beam according to the recognized first deforming state of the device; recognizing a second deforming state of the device; and forming a second audio beam according to the recognized second deforming state of the device.

In an embodiment, the device has a reference portion, the first and the second audio beams are directed substantially to the same direction relative to the reference portion.

In an alternative embodiment, the device has a reference portion, and the first audio beam is directed to a first direction relative to the reference portion, and the second audio beam is directed to a second direction relative to the reference portion, which is different from the first direction.

In an embodiment based on said first and second relative microphone positionings, and first and second audio beams, a first group of microphones of the plurality of microphones are used in forming the first audio beam, and a second group of microphones of the plurality of microphones, which is different from the first group of microphones, is used in forming the second audio beam.

In an embodiment, which can be in accordance with any of the above embodiments, the device has at least two device portions and being deformable by changing a relative positioning of the device portions, the plurality of microphones being distributed to microphone sites located in the two device portions. In this embodiment, the recognizing the deforming state of the device comprises recognizing a relative microphone positioning of the plurality of microphones and determining the deforming state of the device on the basis of the recognized relative microphone positioning and the locations of the microphone sites in the two device portions.

In an alternative embodiment, the device has a loudspeaker, and the recognizing the deforming state of the device comprises: transmitting a test acoustic signal by the loudspeaker; receiving the test acoustic signal by microphones of the plurality of microphones, whereby the microphones produce test output signals; and determining the deforming state of the device on the basis of differences in the test output signals.

In another aspect, a method for forming an audio beam of a foldable device having at least two device portions foldably connected to each other, the device being reversibly foldable between a plurality of folding states, comprises: recognizing the folding state of the device; and forming the audio beam according to beamforming parameters corresponding to the recognized folding state of the device. In this embodiment, the device may comprise at least two microphones, at least one of the at least two microphones lying in each device portion.

In an embodiment, the method comprises: monitoring the folding state of the device; and changing the beamforming parameters when a change of the folding state of the device is detected.

In an embodiment, which may be in accordance with the previous embodiment with monitoring the folding state of the device, the method comprises: determining an assumed use case of the device on the basis of the recognized folding state of the device; and selecting the beamforming parameters according to the assumed use case of the device.

In a device aspect, a device comprises a plurality of microphones having a relative microphone positioning, and a circuitry configured to process output signals of microphones of the plurality of microphones to form an audio beam, wherein the device is a deformable device, and wherein the circuitry is configured to: receive a deforming state of the device; and form the audio beam according to the deforming state of the device.

In an embodiment, the circuitry is configured to: receive a first deforming state of the device; form a first audio beam according to the first deforming state of the device; receive a second deforming state of the device; and form a second audio beam according to the second deforming state of the device.

In an embodiment, the device is a mobile device.

In an embodiment, which may be in accordance with any of the preceding device aspect embodiments, the device is a bendable device, whereby the relative microphone positioning changes when the device is being bent.

In an embodiment, which may be in accordance with any of the preceding device aspect embodiments, the device has at least two device portions with a changeable relative positioning of the device portions, the device being deformable by changing the relative positioning of the device portions, the plurality of microphones being distributed to the at least two device portions, whereby the relative microphone positioning changes when the device is being deformed.

In an embodiment according to the previous embodiment, the two device portions are foldably connected to each other.

In an alternative embodiment, the two device portions are slidably connected to each other.

In an embodiment, which may be in accordance with any of the preceding device aspect embodiments, the device comprises a device deforming sensor configured to detect a form of the device, and wherein the circuitry is configured to recognize the relative microphone positioning on the basis of the detected form of the device.

In an embodiment, which may be in accordance with any of the preceding method or device aspect embodiments, the deformable device comprises multiple detachable components. Each detachable component portion may itself be substantially rigid, flexible, bendable, or rollable, and it may be comprise one or more component portions movably coupled to each other. The plurality of microphones may be distributed in one or more components of the device.

In an embodiment, which may be in accordance with any of the preceding device aspect embodiments, at least one of the plurality of microphones is an omnidirectional microphone.

In any of the above embodiments in the method and device aspects, recognizing, using, or receiving the "deforming state of the device" may comprise recognizing, using, or receiving, respectively, a "relative microphone positioning of the plurality of microphones". For example, in the method aspect, recognizing a deforming state of the device, and forming the audio beam according to the recognized deforming state of the device may comprise recognizing a relative microphone positioning of the plurality of microphones, and forming the audio beam according to the recognized relative microphone positioning of the plurality of microphones, respectively.

The term "comprising" is used in this specification to mean including the features followed thereafter, without excluding the presence of one or more additional features.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The steps of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

The invention claimed is:

1. A method for forming an audio beam of a device having a plurality of microphones, wherein the device is a deformable device, the method comprising:

recognizing a deforming state of the device;

based on the recognized deforming state of the device, determining positions of two or more microphones of the plurality of microphones relative to each other; and forming the audio beam according to the determined positions of the two or more microphones of the plurality of microphones relative to each other.

2. A method as defined in claim 1, wherein the method comprises providing a plurality of predetermined deforming states of the device, and a predetermined audio beam for each such deforming state of the device, and wherein the audio beam is formed according to a predetermined audio beam related to a predetermined deforming state of the device corresponding to the recognized deforming state of the device.

3. A method as defined in claim 1, wherein the method comprises:

recognizing a first deforming state of the device;

forming a first audio beam according to the recognized first deforming state of the device;

recognizing a second deforming state of the device; and forming a second audio beam according to the recognized second deforming state of the device.

4. A method as defined in claim 3, the device having a reference portion, wherein the first and the second audio beams are directed substantially to the same direction relative to the reference portion.

5. A method as defined in claim 3, the device having a reference portion, wherein the first audio beam is directed to a first direction relative to the reference portion, and the second audio beam is directed to a second direction relative to the reference portion, which is different from the first direction.

6. A method as defined in claim 3, wherein a first group of microphones of the plurality of microphones is used in forming the first audio beam, and a second group of microphones of the plurality of microphones, which is different from the first group of microphones, is used in forming the second audio beam.

7. A method as defined in claim 1, the device having at least two device portions and being deformable by changing a relative positioning of the device portions, the plurality of microphones being distributed to microphone sites located in the at least two device portions, wherein the recognizing the deforming state of the device comprises recognizing a relative microphone positioning of the plurality of microphones and determining the deforming state of the device on the basis of the recognized relative microphone positioning and the locations of the microphone sites in the two device portions.

8. A method as defined in claim 1, the device having a loudspeaker, wherein the recognizing the deforming state of the device comprises:

transmitting a test acoustic signal by the loudspeaker;

receiving the test acoustic signal by microphones of the plurality of microphones, whereby the microphones produce test output signals; and determining the deforming state of the device on the basis of differences in the test output signals.

9. A method for forming an audio beam of a device, wherein the device is a foldable device having at least two device portions foldably connected to each other, the device being reversibly foldable between a plurality of folding states, and wherein the method comprises:

recognizing a folding state of the device;

based on the recognized folding state of the device, determining positions of two or more microphones of a plurality of microphones associated with the device relative to at least one of each other or the at least two device portions; and forming the audio beam according to beamforming parameters corresponding to the recognized folding state of the device and the determined positions of the two or more microphones.

10. A method as defined in claim 9, wherein the method further comprises:

monitoring the folding state of the device; and changing the beamforming parameters when a change of the folding state of the device is detected.

11. A method as defined in claim 9, wherein the method further comprises:

selecting the beamforming parameters to form the audio beam, wherein selecting the beamforming parameters comprises selecting two or more microphones whose output signals are used in forming a common output signal corresponding to the formed audio beam.

12. A device comprising:

a plurality of microphones having a relative microphone positioning; and a circuitry configured to process output signals of microphones of the plurality of microphones to form an audio beam;

wherein the device is a deformable device, and wherein the circuitry is configured to:

recognize a deforming state of the device;

based on the recognized deforming state of the device, determine positions of two or more microphones of the plurality of microphones relative to each other; and form the audio beam according to the determined positions of the two or more microphones relative to each other.

13. A device as defined in claim 12, wherein the circuitry is configured to:

receive a first deforming state of the device;

form a first audio beam according to the first deforming state of the device;

receive a second deforming state of the device; and form a second audio beam according to the second deforming state of the device.

14. A device as defined in claim 12, wherein the device is a mobile device.

15. A device as defined in claim 12, wherein the device is a bendable device, whereby the relative microphone positioning changes when the device is being bent.

16. A device as defined in claim 12, wherein the device has at least two device portions with a changeable relative positioning of the device portions, the device being deformable by changing the relative positioning of the device portions, the plurality of microphones being distributed to the at least two device portions, the relative microphone positioning being changed when the device is deformed.

17. A device as defined in claim 16, wherein the at least two device portions are foldably connected to each other.

18. A device as defined in claim 16, wherein the at least two device portions are slidably connected to each other.

19. A device as defined in claim 12, wherein the device comprises a device deforming sensor configured to detect a form of the device, and wherein the circuitry is configured to recognize the deforming state of the device on the basis of the detected form of the device.

20. A device as defined in claim 12, wherein at least one of the plurality of microphones is an omnidirectional microphone.

* * * * *